United States Patent [19]

Levine

[11] Patent Number: 4,847,956

[45] Date of Patent: Jul. 18, 1989

[54] BAR CLOSURE FOR OPEN BAGS

[76] Inventor: Richard E. Levine, P.O. Box 2436, Santa Barbara, Calif. 93120

[21] Appl. No.: 26,121

[22] Filed: Jul. 14, 1987

[51] Int. Cl.[4] ..... B65D 77/10

[52] U.S. Cl. ..... 24/30.5 R; 24/505; 24/509

[58] Field of Search ..... 24/30.5 R, 30.5 L, 67.7, 24/499, 457, 509, 510, 611, 505, 563

[56] References Cited

U.S. PATENT DOCUMENTS

| | | | |
|---|---|---|---|
| 381,265 | 4/1888 | Martens | 24/30.5 R |
| 474,719 | 5/1892 | Brande | 24/457 |
| 609,989 | 8/1898 | Gans | 24/30.5 R |
| 834,493 | 10/1906 | Rubin | 24/499 |
| 904,595 | 11/1908 | Barmore | 24/509 |
| 1,615,889 | 2/1927 | Senn | 24/509 |
| 2,408,145 | 6/1946 | Johnson | 24/509 |
| 3,036,506 | 5/1962 | Andresen, Jr. | 24/30.5 R |
| 3,060,530 | 10/1962 | Harvey | 24/509 |
| 3,649,954 | 3/1972 | Kurtz | 24/505 |
| 3,896,527 | 7/1975 | Miller et al. | 24/DIG. 22 |
| 4,253,216 | 3/1981 | Brown | 24/67.7 |
| 4,523,353 | 6/1985 | Hubbard et al. | 24/30.5 R |
| 4,738,007 | 4/1988 | Demarest, Jr. | 24/563 |

FOREIGN PATENT DOCUMENTS

| | | | |
|---|---|---|---|
| 0156779 | 10/1985 | European Pat. Off. | 24/30.5 R |

*Primary Examiner*—Victor N. Sakran

[57] ABSTRACT

Two bars are hinged together on one end to clamp tight on the open end of a flexible bag. The other ends of the bars are held together by a multi step latch. The closure accommodates to bag material of different thicknesses by expansible hinge structure of FIG. 5 and the multi step latch so that the bars 1 and 2 can be latched parallel to each other to close a bag. The expansible hinge allows the upper bar to move upwardly against the tension of spring 10.

1 Claim, 1 Drawing Sheet

BAR CLOSURE FOR OPEN BAGS

FIELD OF THE INVENTION

This invention relates to manually operable mechanical closures for open bags to retain freshness of the contents as well as retaining the contents within the bags.

DESCRIPTION OF PRIOR ART

Closures for open bags and other flexible containers have been used for many years. A problem arises when the original seal of the bag is broken to remove some of the contents and it is desired to again seal the bag to preserve the freshness or crispness of the remaining contents. For example bags of potato chips, corn chips and the like become soggy if exposed to high humidity air and the quality is thereby reduced. Prior devices have not adequately sealed and there exists a need for an inexpensive and reliable mechanical closure to reliably seal open bags and especially to accommodate irregularities in the bag structure such as wrinkles and overlapping seams.

SUMMARY OF THE INVENTION

I have devised a bar seal in the form of two hinged bars between which a bag mouth can be inserted. The hinged bars are then closed and held in closed position by a manually releasable latch. The mating surfaces of the hinged bars are provided with resilient surfaces of an effective type to accommodate irregularities of the bag such as overlapping seams and wrinkles. The hinge joining the bars is not a fixed hinge but the hinge axis is spring loaded and moveable to accommodate bags having thick and bulky bag walls.

BRIEF DESCRIPTION OF THE DRAWINGS

Various objects advantages and features of the invention will be apparent in the following description and claims including the drawings forming an integral part of this specification in which:

BRIEF DESCRIPTION OF THE PREFERRED EMBODIMENT

Figure 1:
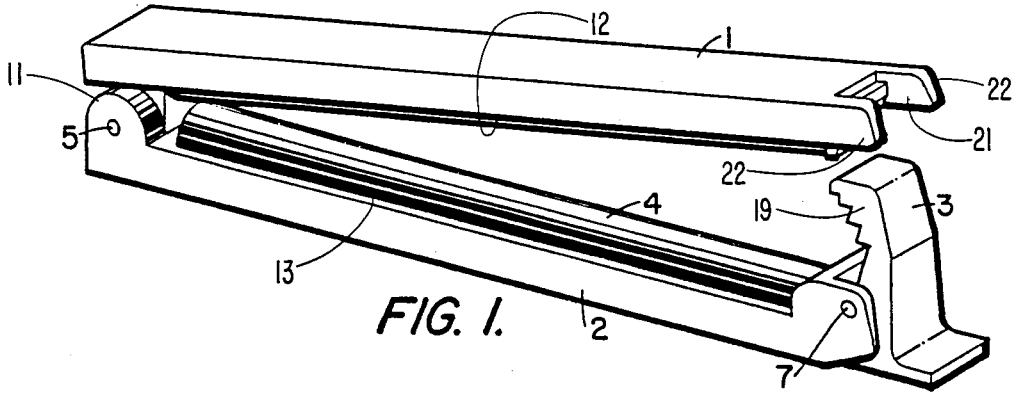
FIG. 1 is a three dimensional view of my presently preferred bar closure showing the bars slightly open.
Figure 2:
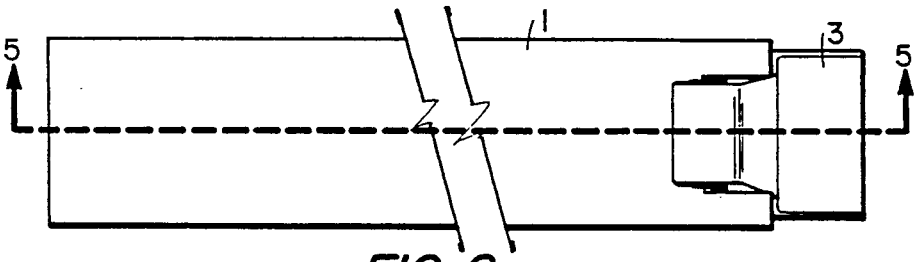
FIG. 2 is a plan view of the bar closure of FIG. 1 after bars are in closed position.

Referring to FIG. 1 there is illustrated a pair of bars 1 and 2 hinged together at the left end by a vertically expandable hinge employing as one component a pin 5 disposed in a pair of upstanding ears 11. The bars 1 and 2 have mating surfaces 12 and 13 to which are secured resilient material 4. The resilient material may have a longitudinal air space 14 (FIG. 5) to assist in elastic deflection and for example, the cross section of the resilient material may be D shaped with the flat part of the D secured to the mating surfaces 12 and 13.

Figure 5:
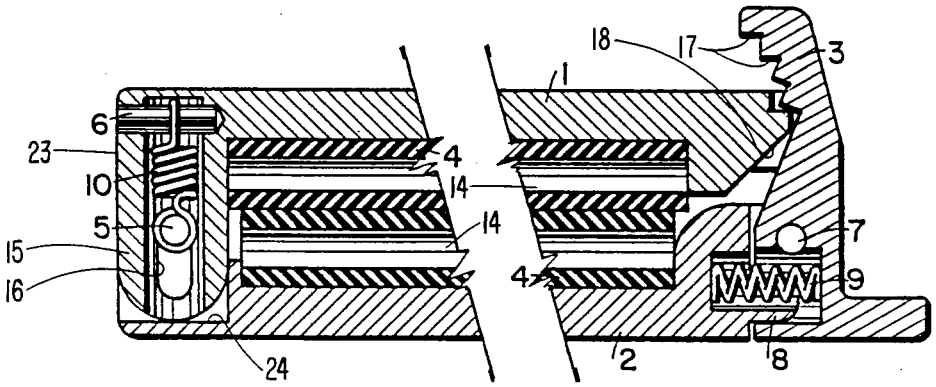
FIG. 5 is a sectional view taken along the line 5—5 of FIG. 2.

Referring now to the left end of FIG. 5 there is disclosed the vertically expandable hinge structure. Depending downwardly from the left end of bar 1 is a tongue 15 having a vertical slot 16 and the pin 5 is disposed in this slot 16. Secured to the pin 5 is a tension spring 10, the upper end of which is connected to the bar 1 by a pin 6. Therefore, when thick bag material is gripped by the rubber material 4, the bar 1 will move vertically upwardly by the amount of thickness of the bag material. This movement continues until the pin 5 engages the bottom end of the slot 16.

Referring still to the left end of FIG. 5, structure is provided to hold the upper bar at 90° to the lower bar 2, to free the hands of the operator to insert a bag opening across the rubber material 4 of the lower bar 2. The downwardly extending tongue 15 has a flat outer surface 23 that engages a flat 24 formed on the lower bar 2. To accomplish this relationship, the two bars 1 and 2 are manually pulled apart at their left ends against the tension of spring 10. They are then manually rotated 90° and the pull against spring 10 is released. The flat surface 23 will then engage the flat surface 24 to hold the bars at 90° to each other.

Referring now to the right end of FIG. 5, a latch 3 is pivoted to the bar 2 by a pin 7. The latch 3 is resiliently urged in a counter clockwise direction by a compression spring 9 disposed in recesses in the bar 2 and the latch 3. The upper end of latch 3 has a series of notches 17 for engaging the upper bar 1. These notches 17 may referred to as steps and the entire latch mechanism may be referred to as a multi step latch.

Figure 3:
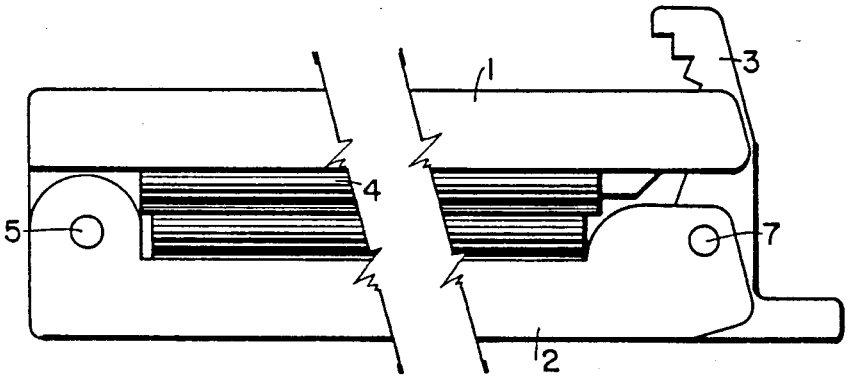
FIG. 3 is an elevation view of the bar closure of FIG. 1 with the bars in closed position and held by the multi step latch.

Referring still to the right end of FIG. 5, the right end of the bar 1 has a camming surface 18 disposed at an acute angle to the bar 1. Therefore, when the bars 1 and 2 are apart as shown in FIG. 1, and the operator closes them to a parallel relationship, the camming surface 18 will engage the top to latch 3, rotating it in a clockwise direction which permits the upper bar 1 to rotate to a position parallel to the lower bar as shown in FIGS. 3 and 5.

Figure 4:
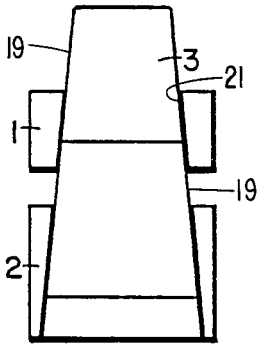
FIG. 4 is a side view of the right end of the bar closure of FIG. 3.

Referring now to FIG. 4 it will be noted that the latch 3 has tapered sides 19 that engage tapered inside edges 21 disposed on projecting points 22 shown also in FIG. 1. The tapered edges 19 guide the upper bar 1 as it closes to a parallel position with bar 2.

OPERATION

Referring to FIG. 5, the operator manually rotates latch 3 counter clockwise to release bar 1 and then pulls the left end apart against the tension of spring 10. The bars can then be rotated 90° to each other and will be held at 90° by the flat 23 engaging flat 24. The operator can then lay the mouth of an open bag (for example an opened bag of potato chips) on the rubber material 4 on the lower bar 2. The operator manually then rotates the upper bar 1 toward the lower bar. The camming surface 18 will strike the upper end of latch 3, rotating it clockwise and the bar 1 can continue to a position parallel to bar 2.

The notches 17 of latch 3 will engage the top of bar 1 and lock it to bar 2. If the bag material is thick, tension spring 10 at the left in FIG. 5 will deflect resulting in the bars 1 and 2 being parallel by the proper latch notch 17 engaging bar 1.

The bar closure will remain with the bag until it is again desired to open the bag.

I have described my invention with respect to a presently preferred embodiment as required by the patent statutes. It will be obvious to those skilled in the art that various modifications and changes can be made. All such variations and modifications that come within the true spirit and scope of the invention are included within the scope of the following claims.

I claim:

1. A bar closure for open bags and the like comprising:

(a) a pair of elongated bars having ends and mating surfaces;

(b) an expansible hinge connecting the bars at one of their ends, permitting rotation from an angle of 90 degree to each other to a parallel position of the bars, said expansible hinge including a vertical slot in one bar, a pin in the other bar transverse to the elongation of its bar and passing through the slot, and a tension spring attached to the pin and to the one bar;

(c) a multi step latch selectively engaging the bars at their other ends;

(d) and resilient material disposed on both bars at the mating surface, whereby the resilient material effectively closes a bag gripped between the mating surfaces regardless of overlapping seams and wrinkles on the bag, and the expansible hinge joint and multi step latch accommodate bag material of different thicknesses.

* * * * *